US009492799B1

(12) United States Patent
Villaseñor

(10) Patent No.: US 9,492,799 B1
(45) Date of Patent: Nov. 15, 2016

(54) PAINT AGITATING SYSTEM

(71) Applicant: Jose A. Villaseñor, Tucson, AZ (US)

(72) Inventor: Jose A. Villaseñor, Tucson, AZ (US)

( * ) Notice: Subject to any disclaimer, the term of this patent is extended or adjusted under 35 U.S.C. 154(b) by 0 days.

(21) Appl. No.: 14/796,820

(22) Filed: Jul. 10, 2015

Related U.S. Application Data

(63) Continuation-in-part of application No. 13/973,605, filed on Aug. 22, 2013, now Pat. No. 9,084,971.

(60) Provisional application No. 61/692,094, filed on Aug. 22, 2012.

(51) Int. Cl.

| | |
|---|---|
| ***B01F 7/00*** | (2006.01) |
| ***B01F 7/16*** | (2006.01) |
| ***B05B 7/24*** | (2006.01) |
| ***B01F 7/20*** | (2006.01) |
| ***B01F 3/12*** | (2006.01) |

(52) U.S. Cl.
CPC ..... *B01F 7/00291* (2013.01); *B01F 3/1221* (2013.01); *B01F 7/1695* (2013.01); *B01F 7/20* (2013.01); *B05B 7/2408* (2013.01); *B01F 2215/005* (2013.01)

(58) Field of Classification Search
CPC ..... B05B 7/40; B05B 7/0408; B05B 7/2408; B01F 7/1695; B01F 7/00291
See application file for complete search history.

(56) References Cited

U.S. PATENT DOCUMENTS 1,698,402 A * 1/1929 Harris ..... B01F 7/00208 366/247
2,027,297 A * 1/1936 Tramposch ..... B01F 7/1695 366/254
3,381,941 A * 5/1968 Gibson ..... B01F 7/00066 366/308
3,672,645 A * 6/1972 Terrels ..... B05B 15/003 239/142
4,175,875 A 11/1979 Van Horbek
4,844,355 A * 7/1989 Kemp, Jr. ..... B02C 17/163 241/172
4,887,910 A * 12/1989 Bravo ..... A23G 9/224 366/205
4,944,600 A * 7/1990 McKelvey ..... B01F 7/00291 366/142
5,251,979 A * 10/1993 Larsen ..... B01F 7/1695 366/248
5,676,463 A * 10/1997 Larsen ..... B01F 7/1695 366/251
6,419,385 B1 7/2002 Walls
6,712,499 B2 * 3/2004 Fink, Jr. ..... B28C 5/12 366/325.5
6,820,824 B1 11/2004 Joseph et al.
8,414,180 B1 4/2013 Mattingly et al.
2004/0228209 A1 11/2004 Bielozer

* cited by examiner

*Primary Examiner* — Ryan Reis

(57) ABSTRACT

A paint agitating system having a mixing cup and a paint agitating paddle. A plurality of paddle blades is fixedly attached to a paddle shaft so as to prevent independent rotation of the paddle blade relative to the paddle shaft. A blade arm extends outwardly and away from a blade shoulder to for the paddle blade. An interior blade area disposed between the blade arm and the blade shoulder of each paddle blade has at least one interior opening being devoid of obstruction. A flexible blade is disposed on each paddle blade. When paint is poured into the mixing cup, the paint is mixed by rotating the paddle via the paddle shaft. The flexible blade scrapes off the paint from the cup interior surface to ensure uniform mixing of the paint.

16 Claims, 6 Drawing Sheets

PAINT AGITATING SYSTEM

CROSS REFERENCE

This application is a continuation-in-part of and claims priority to U.S. patent application Ser. No. 13/973,605 filed Aug. 22, 2013, and claims priority to U.S. Provisional Patent Application No. 61/692,094 filed Aug. 22, 2012, the specification(s) of which is/are incorporated herein in their entirety by reference.

FIELD OF THE INVENTION

The present invention relates to equipment and system used for painting, or more specifically, paint systems and paint paddles used to agitate or stir paint.

BACKGROUND OF THE INVENTION

Paint can be defined as a liquid, liquefiable, or mastic composition which, after applying a thin layer to a substrate, leaves a solid film upon drying. It is most commonly used to protect, color, or provide texture to an object. Typically, paint stir sticks are used to mix paint prior to application, although other mechanical stirring means may be used, such as motorized paint stirrers and pain shakers (paint tumblers). However, these mechanisms may not be effective in thoroughly mixing paint due to their inability to consistently move the paint sticking to the interior surfaces of a mixing container. Hence, there is a need for a paint agitating system that can thoroughly mix paint in a mixing container.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The subject disclosure features a paint agitating system comprising a generally cylindrical mixing cup, a paint agitating paddle, and a rotating means. The mixing cup may comprise an open cup top, a smooth cup interior surface, and a cup interior cavity. The paint agitating paddle may comprise a plurality of paddle blades fixedly attached to a paddle shaft. Each paddle blade may comprise a blade arm extending outwardly and away from a blade shoulder. An interior blade area disposed between the blade arm and the blade shoulder of each paddle blade may comprise at least one interior opening being devoid of obstruction. A flexible blade may be disposed on each paddle blade. A blade shoulder posterior end of each blade shoulder may be fixedly attached to a shaft distal end and a shaft posterior end may project outwardly and away from the blade shoulder. Each paddle blade may further comprise an arm extension projecting outwardly and away from the blade arm. The arm extension posterior end can be fluidly connected to a blade arm distal end. The arm extension may parallel to the blade shoulder. Each arm extension distal end may be connected to the distal ends of the other arm extensions to form a contiguous paddle. The rotating means can rotate the paddle via the paddle shaft. Each paddle blade is affixed to the paddle shaft so as to prevent independent rotation of the paddle blade relative to the paddle shaft.

When paint is poured into the cup interior cavity of the mixing cup, the paint is mixed by the paddle. The rotating means is disposed on the shaft and the paddle is rotated via the rotating means to mix the paint. As the paddle is being rotated, the flexible blade scrapes off the paint from the cup interior surface to ensure uniform mixing of the paint. The paint may also freely flow through the interior openings of the rotating paddle to ensure adequate agitation.

DESCRIPTION OF PREFERRED EMBODIMENTS

Figure 1:
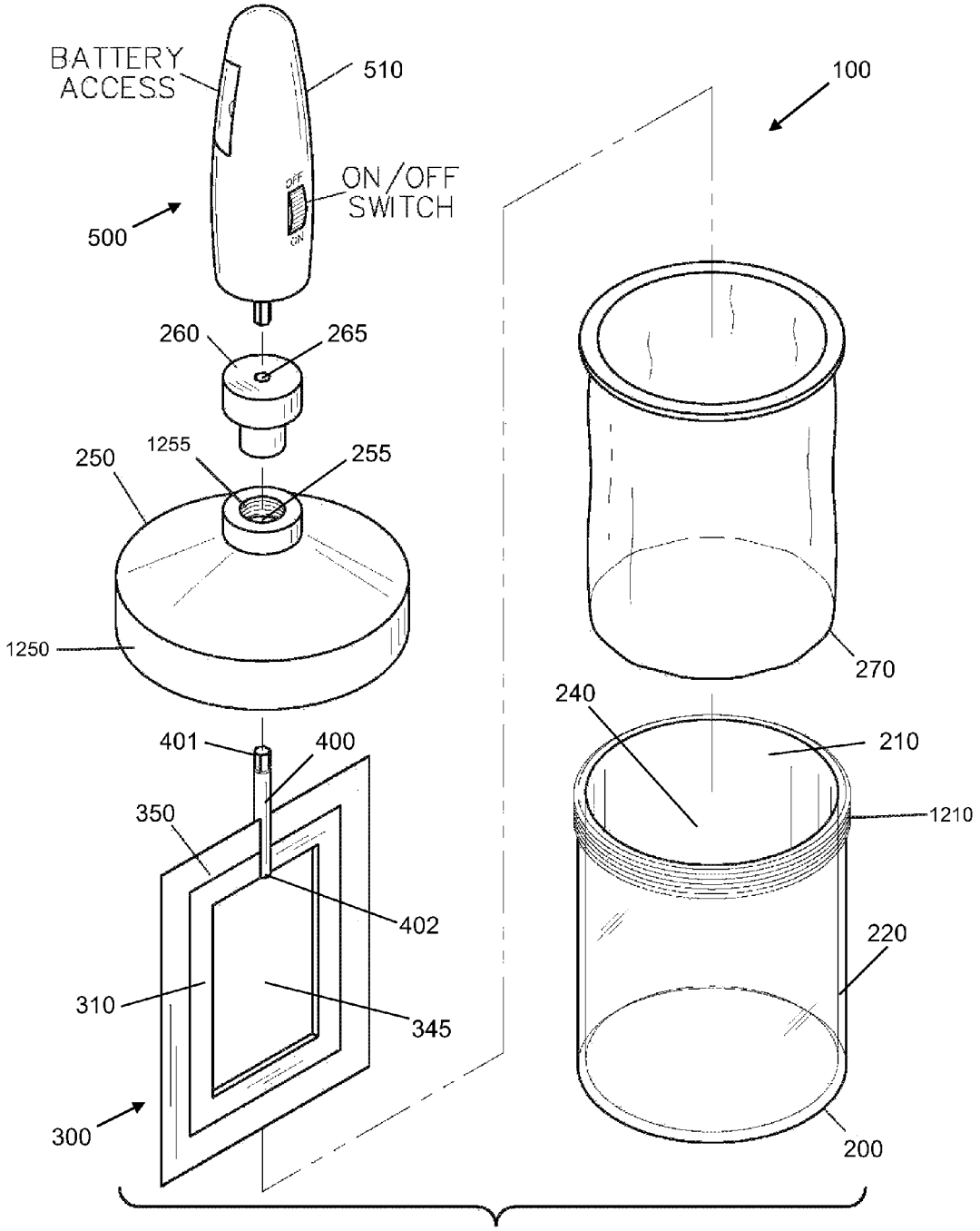
FIG. 1 is a perspective view of the present invention featuring a mixing cup, a paddle, and a rotating means.

Following is a list of elements corresponding to a particular element referred to herein:

100 paint agitating system
200 mixing cup
210 open cup top
220 cup interior surface
240 cup interior cavity
250 lid
255 lid aperture
260 adapter
265 adapter aperture
270 cup liner
300 paint agitating paddle
310 paddle blade
320 blade arm
321 blade arm posterior end
322 blade arm distal end
330 blade shoulder
331 blade shoulder posterior end
332 blade shoulder distal end
340 interior blade area
345 interior opening
350 flexible blade
360 arm extension
361 arm extension posterior end
362 arm extension distal end
370 blade outer edge
400 paddle shaft
401 shaft posterior end
402 shaft distal end

500 rotating means
510 motor drive
530 crank
600 paint sprayer

Figure 2:
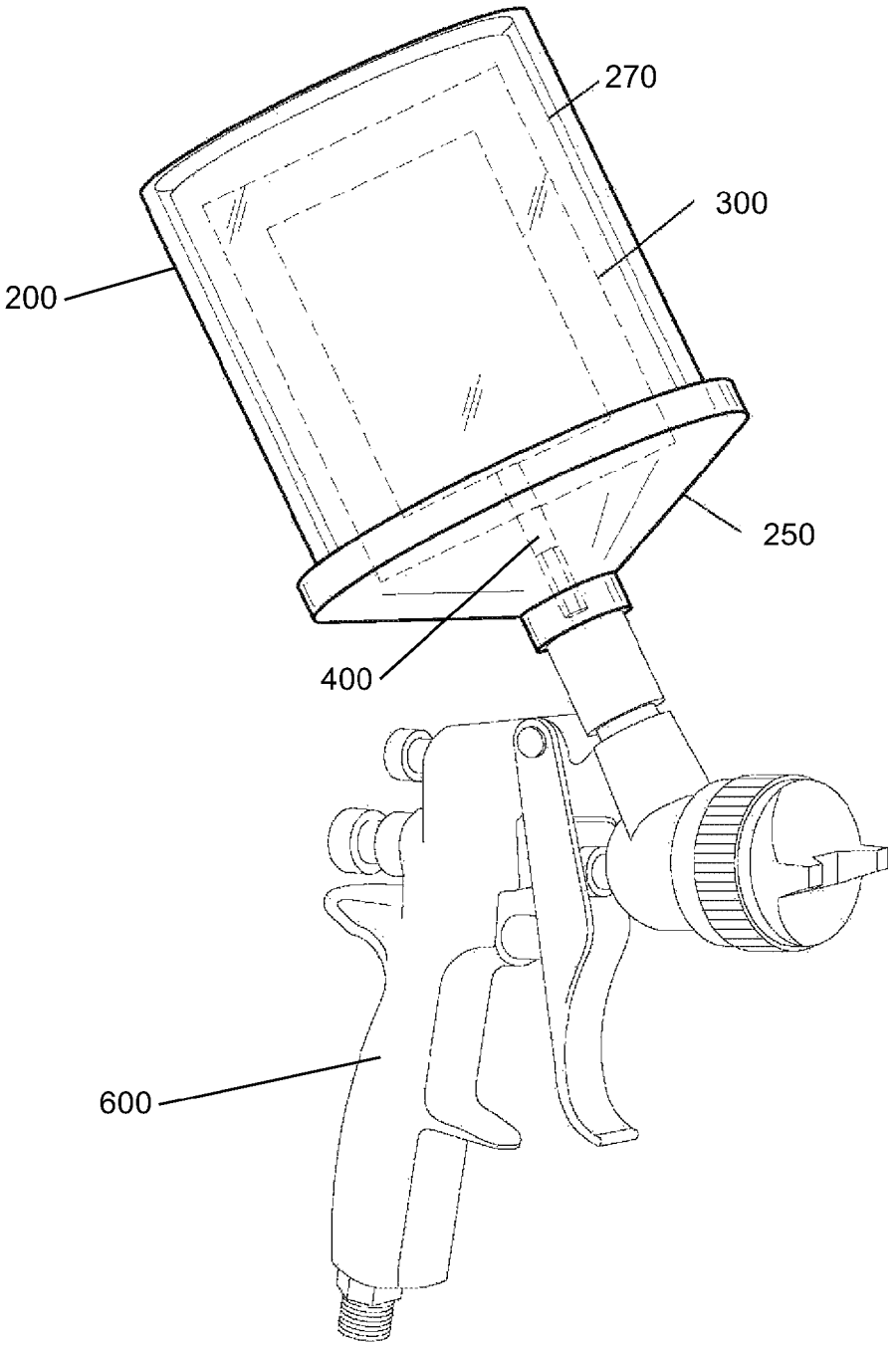
FIG. 2 is a perspective view of an alternate embodiment of the present invention featuring a paint sprayer.
Figure 3:
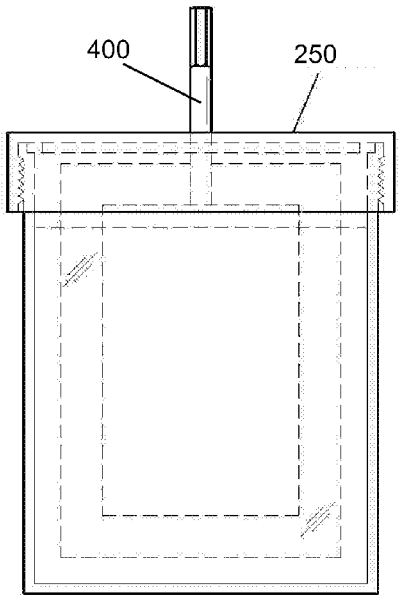
FIG. 3 is a front view of the mixing cup and the paddle of the present invention.
Figure 4:
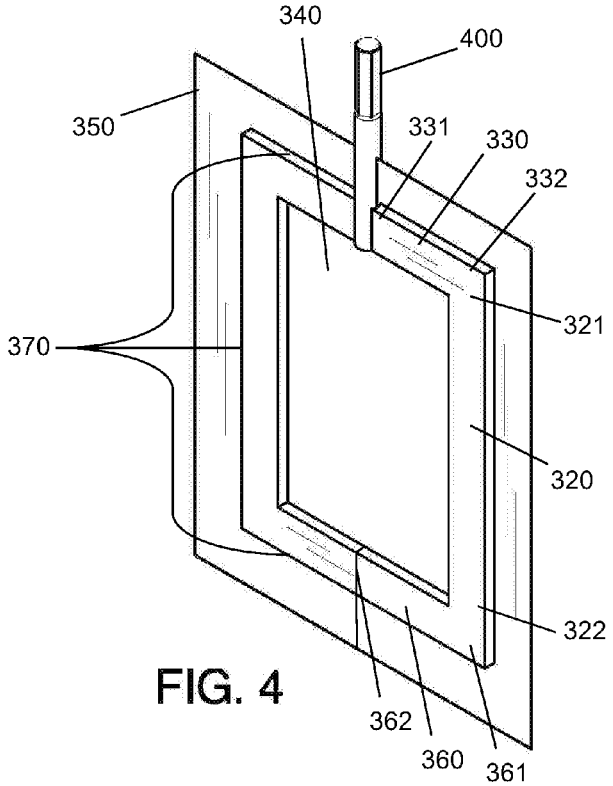
FIG. 4 is a perspective view of the paddle of the present invention.
Figure 5:
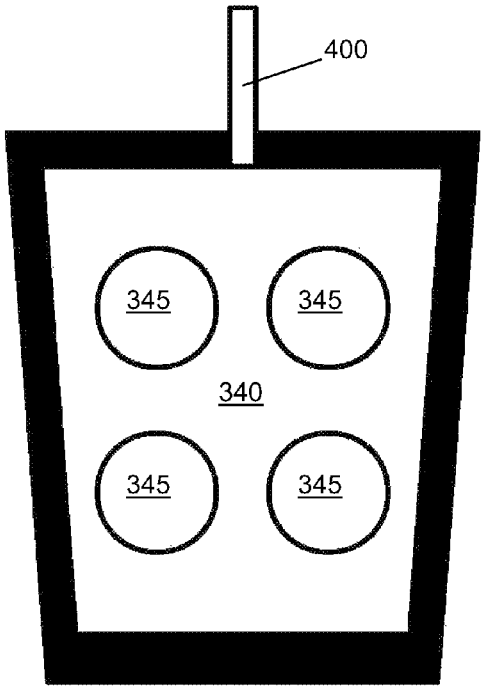
FIG. 5 is a front view of an alternate embodiment of the paddle of the present invention featuring a plurality of circular interior openings.
Figure 6:
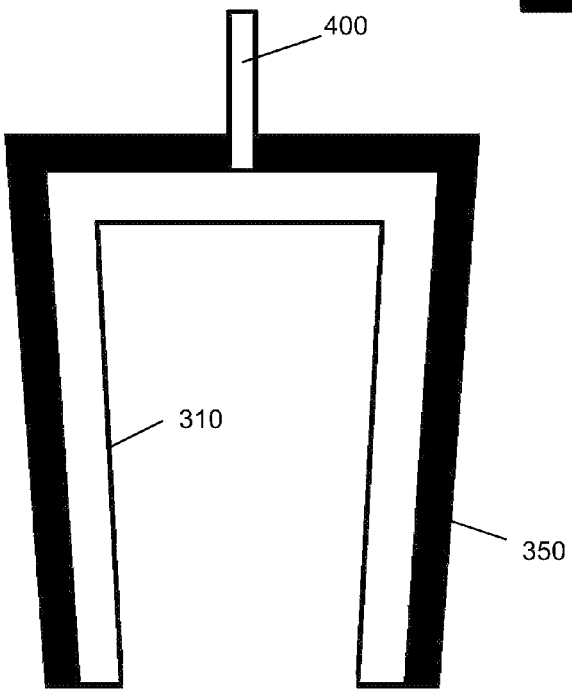
FIG. 6 is a front view of an alternate embodiment of the paddle of the present invention featuring a rectangular interior opening.
Figure 7:
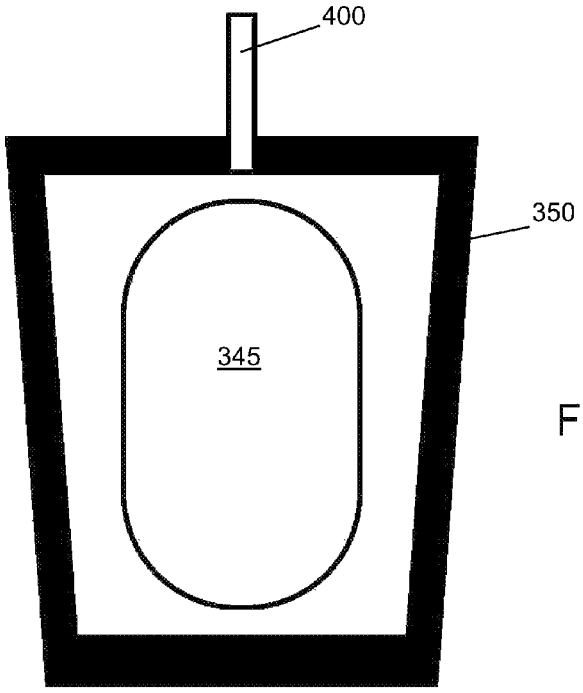
FIG. 7 is a front view of an alternate embodiment of the paddle of the present invention featuring a circular interior opening.
Figure 8:
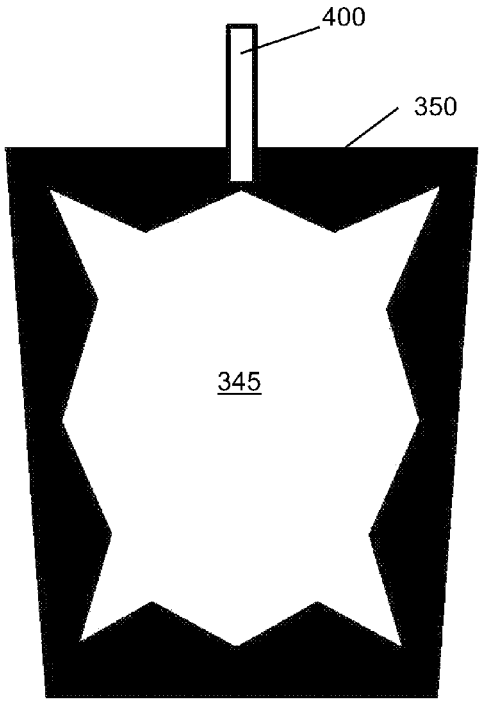
FIG. 8 is a front view of an alternate embodiment of the paddle of the present invention featuring an irregularly interior opening.
Figure 9:
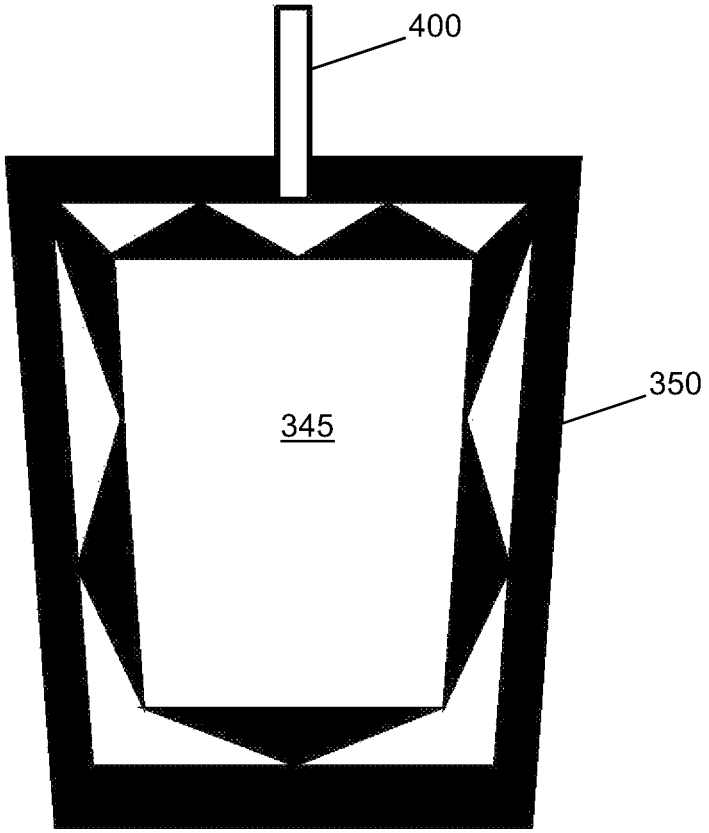
FIG. 9 is a front view of an alternate embodiment of the paddle of the present invention.

Referring now to FIGS. 1-9, the present invention features a paint agitating system (100) comprising a generally cylindrical mixing cup (200), a paint agitating paddle (300), and a rotating means (500). In some embodiments, the mixing cup (200) may comprise an open cup top (210), a smooth cup interior surface (220), and a cup interior cavity (240).

In other embodiments, the mixing cup may further comprise a smooth cup side wall, a smooth cup bottom interior surface, a cup height and a cup diameter. In one embodiment, the cup diameter tapers, while in another embodiment, the cup diameter remains constant. For instance, the mixing cup may taper to a smaller diameter as the cup side wall approaches the bottom interior surface. Non-limiting example of mixing cups include a paint can or a cup for a spray gun.

In some embodiments, the paint agitating paddle (300) comprises a plurality of paddle blades (310) fixedly attached to a paddle shaft (400). Each paddle blade (310) may comprise a blade arm (320) extending outwardly and away from a blade shoulder (330). For example, a blade arm posterior end (321) of the blade arm (320) is fluidly connected to a blade shoulder distal end (332) of the blade shoulder (330). In other embodiments, an interior blade area (340) disposed between the blade arm (320) and the blade shoulder (330) of each paddle blade (310) may comprise at least one interior opening (345) being devoid of obstruction. Preferably, each paddle blade (310) is at a fixed angle with respect to each other. As used herein, the fixed angle is defined as the angle between paddle blades that are directly next to, or neighboring, each other. The fixed angle between neighboring paddle blades (310) may range from between about 45° to 180°. Non-limiting examples include a paddle with two paddle blades having a fixed angle of about 180°, a paddle with three paddle blades having a fixed angle of about 120°, a paddle with four paddle blades having a fixed angle of about 90°, or a paddle with eight paddle blades having a fixed angle of about 45°.

In some embodiments, a flexible blade (350) may be disposed on each paddle blade (310). For instance, the flexible blade (350) may be disposed on a blade outer edge (370). In other embodiments, the flexible blade (350) is located on a blade top edge, a blade outer side edge, a blade bottom edge, or a combination thereof. In still other embodiments, the flexible blade (350) may be a single, contiguous unit or a divided into a plurality of pieces. Preferably, the flexible blade (350) is constructed from a rubber, a silicone rubber, a polymer, or a flexible material such that the flexible blade (350) functions similar to a squeegee.

In some embodiments, a blade shoulder posterior end (331) of each blade shoulder (330) may be fixedly attached to a shaft distal end (402) of the paddle shaft (400) such that the paddle shaft (400) does not enter into the interior blade area (340). In other embodiments, a shaft posterior end (401) may project outwardly and away from the blade shoulder (330).

In some embodiments, each paddle blade (310) may further comprise an arm extension (360) projecting outwardly and away from the blade arm (320). The arm extension posterior end (361) can be fluidly connected to a blade arm distal end (322). Preferably, the arm extension (360) is parallel to the blade shoulder (330). In other embodiments, each arm extension distal end (362) is connected to the distal ends of the other arm extensions to form a contiguous paddle.

In some embodiments, the rotating means (500) can rotate the paddle (300) via the paddle shaft (400). In preferred embodiments, each paddle blade (310) is affixed to the paddle shaft (400) so as to prevent independent rotation of the paddle blade (310) relative to the paddle shaft (400). For example, the rotation of the paddle shaft via the rotation means causes the paddle to rotate with the paddle shaft, however, the paddle does not independently rotate about the paddle shaft. In some embodiments, the rotating means (500) is a motor drive (510) that can attachably connect to the shaft (400) for rotation. Exemplary motor drives (510) may be an electric screwdriver or a drill. In other embodiments, the rotating means (500) is a handle (520) that attachably connects to the shaft (400) for rotation. In still other embodiments, the rotating means (500) is a crank (530) that attachably connects to the shaft (400) for rotation.

In preferred embodiments, when paint is poured into the cup interior cavity (240) of the mixing cup (200), the paint is mixed by the paddle (300). For example, the paddle (300) may be disposed, or placed, in the cup interior cavity (240). The rotating means (500) is disposed, i.e. fastened, on the shaft (400) and the paddle (300) is rotated via the rotating means (500) to mix the paint. Preferably, as the paddle is being rotated, the flexible blade (350) scrapes off the paint from the cup interior surface (220) to ensure uniform mixing of the paint. The paint may also freely flow through the interior openings (345) of the rotating paddle (300) to ensure adequate agitation.

In some embodiments, the paddle (300) comprises two paddle blades (310), three paddle blades (310), or four paddle blades (310). In other embodiments, the paddle (300) may comprise more than four paddle blades (310). For example, the paddle (300) may have two paddle blades (310) to form a shape of a horseshoe. As another example, the paddle (300) may have four paddle blades (310) to form a shape of a cross. Regardless of the number of paddle blades (310), the paddle (300) is continuous, unitary body.

Additional embodiments of the cup (200) further comprise a lid (250) having a lid aperture (255) centrally disposed therein. In one embodiment, the lid is planar; yet in another embodiment, the lid (250) is conical such that the lid tapers to the lid aperture (255). In some embodiments, the lid (250) may be disposed on the open cup top (210) to effectively enclose, cover, and seal the cup interior cavity (240), thereby preventing paint from spilling out of the cup (200). When the paddle is disposed in the cup interior cavity (240), the paddle shaft (400) can be rotatably disposed through the lid aperture (255), i.e. the paddle shaft posterior end (401) protrudes through the lid aperture (255) and outside of the lid (250).

In other embodiment, an adapter (260) may be centrally disposed in the lid aperture (255). The adapter (260) may comprise an adapter aperture (265) centrally disposed therein such that the shaft (400) is rotatably disposed through the adapter aperture (265).

In alternative embodiments, a cup liner (270) may be slidably disposed in the mixing cup (200) such that the cup liner (270) interfacially contacts the cup interior surface (220). The cup liner (270) may be disposable to allow for the mixing cup (200) to be reused. In some embodiments, the cup liner (270) is constructed from a plastic or paper material.

In other embodiments, the system (100) may further comprise a paint sprayer (600). The mixing cup (200) can be disposed o, i.e. operatively connected to, the paint sprayer (600). For example, the paint in the mixing cup (200) can be agitated on the paint sprayer (650) via the paddle (300) being rotated by the rotating means (500) to ensure uniform color and consistency of the paint.

In some embodiments, the interior opening (345) has a circular shape, a rectangular shape, or an irregular shape. In other embodiments, the interior blade area (340) may comprise at least two interior openings (345), each being devoid of obstruction. In still further embodiments, the interior blade area (340) may comprise a plurality of openings (345), each being devoid of obstruction. In one embodiment, each interior blade area (340) is fluidly connected to the other interior blade areas. In another embodiment, each interior opening (345) is fluidly connected to the other interior openings to form a single and continuous interior blade opening. For example, the interior blade opening may be centrally disposed on the paddle. A center of the paddle may be defined as a region in between the paddle blades that partially lies on an Axis A, the Axis A being an axis that passes through and is aligned with the paddle shaft.

An exemplary embodiment of the present invention may feature a paint agitating paddle (300) having a plurality of paddle blades (310) fixedly attached to a paddle shaft (400). The paddle (300) may be used to mix paint in a mixing container so as to provide a uniform and consistent mixing of the paint. Each paddle blade (310) can comprise a blade arm (320) extending outwardly and away from a blade shoulder (330). A blade arm posterior end (321) can be fluidly connected to a blade shoulder distal end (332). An interior blade area (340) disposed between the blade arm (320) and the blade shoulder (330) of each paddle blade (310) may comprise at least one interior opening (345) being devoid of obstruction. A blade shoulder posterior end (331) of each blade shoulder (330) can be fixedly attached to a shaft distal end (402) of the paddle shaft (400). A shaft posterior end (401) can projects outwardly and away from the blade shoulder (330). Each paddle blade (310) may further comprise an arm extension (360) projecting outwardly and away from the blade arm (320). An arm extension posterior end (361) may be fluidly connected to a blade arm distal end (322). The arm extension (360) may be parallel to the blade shoulder (330). Each arm extension distal end (362) may be fixedly connected to the other arm extension distal end. A flexible blade (350) may be disposed on each paddle blade (310), preferably on a blade outer edge (370). Each paddle blade (310) is at a fixed angle with respect to each other, as well as being affixed to the paddle shaft (400) so as to prevent independent rotation of the paddle blade (310) relative to the paddle shaft (400).

An alternative embodiment features a paddle having a plurality of paddle blades. Each paddle blade comprises a paddle first surface, an opposing paddle second surface, a paddle top edge, an opposing paddle bottom edge, a paddle outside edge, and an opposing paddle inside edge. The paddle blades are connected at the paddle inside edges. The paddle blades may comprise one or more cutouts forming an interior opening. The cutouts combine to form a single shaped interior opening. There can be a plurality of individual cutouts that do not touch that combine to form the interior opening. A shaft may be located at an intersection of the paddle top edges. The shaft can project out and away from the paddle top edges. The shaft can be located along an Axis A.

In an alternative embodiment, a paddle inside notch may be located on the paddle inside edge of the paddle blade. A plurality of paddle inside notches may be fluidly connected to form the interior opening. Alternatively, the plurality of paddle inside notches may not be fluidly connected, but each comprises an open area together forming the interior opening. In some embodiments, the interior opening may be formed by one or more paddle inside notches and one or more secondary paddle blade components located on each paddle inside notch. In other embodiments, the paddle blades comprise a cutout or a notch on the paddle bottom edge. In still other embodiments, two opposed paddle blades intersect and comprise a general shape of a horseshoe.

Another alternative embodiment features a paddle having a plurality of paddle blades, each comprising a paddle first surface, a paddle second surface, a paddle top edge, a paddle bottom edge, a paddle outside edge, a paddle inside edge, and a paddle inside notch. The paddle blades can be connected at the paddle inside edges. The paddle inside notches can be fluidly connected to form an interior opening. Preferably, the paddle blades are connected at the paddle inside edges via unitary construction. A shaft may be located on the paddle top edge and projects out and away from the paddle top edge at the intersection of the paddle top edge and the paddle inside edge. The shaft may be located on an Axis A that lies on the paddle inside edge.

As used herein, the term "about" refers to plus or minus 10% of the referenced number.

The disclosures of the following U.S. Patents are incorporated in their entirety by reference herein: U.S. Pub. No. 2004/0028209, U.S. Pat. No. 1,698,402, U.S. Pub. No. 2004/0028209, U.S. Pat. No. 3,672,645, U.S. Pat. No. 4,175,875, U.S. Pat. No. 4,944,600, U.S. Pat. No. 5,676,463, U.S. Pat. No. 6,419,385, U.S. Pat. No. 6,712,499, U.S. Pat. No. 6,820,824, U.S. Pat. No. 8,414,180.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A paint agitating system (100), wherein said system (100) comprises:

a. a generally cylindrical mixing cup (200) having an open cup top (210), a smooth cup interior surface (220), and a cup interior cavity (240); and b. a paint agitating paddle (300) having a plurality of paddle blades (310) fixedly attached to a paddle shaft (400);

wherein each paddle blade (310) comprises a blade arm (320) extending outwardly and away from a blade shoulder (330), wherein a blade arm posterior end (321) is fluidly connected to a blade shoulder distal end (332), wherein an interior blade area (340) disposed between the blade arm (320) and the blade shoulder (330) of each paddle blade (310) comprises at least one interior opening (345) being devoid of obstruction, wherein each interior blade area (340) is directly connected to each other, wherein a flexible blade (350) is disposed on each paddle blade (310);

wherein a blade shoulder posterior end (331) of each blade shoulder (330) is fixedly attached to a shaft distal end (402) of the paddle shaft (400), wherein a shaft posterior end (401) projects outwardly and away from the blade shoulder (330);

c. a rotating means (500) for rotating the paddle (300) via the paddle shaft (400);

wherein each paddle blade (310) is at a fixed angle with respect to each other, wherein each paddle blade (310) is affixed to the paddle shaft (400) so as to prevent independent rotation of the paddle blade (310) relative to the paddle shaft (400);

wherein the paddle (300) is disposed in the cup interior cavity (240), wherein the rotating means (500) is disposed on the shaft (400) and the paddle (300) is rotated via the rotating means (500) to mix paint in the cup interior cavity (240), wherein the flexible blade (350) scrapes off the paint from the cup interior surface (220) to ensure uniform mixing of the paint, wherein the cup (200) further comprises a lid (250) having a lid aperture (255) with an internal threading (1255) centrally disposed therein, wherein the lid (250) with an internal threading (1250) is secured tightly on the open cup top (210) with an external threading (1210), wherein the paddle shaft (400) is rotatably disposed through the lid aperture (255), wherein an adapter (260) is centrally and threadably disposed in the lid aperture (255), wherein the adapter (260) comprises an adapter aperture (265) centrally disposed therein, wherein the shaft (400) is rotatably disposed through the adapter aperture (265), wherein a paint sprayer (600) is threadably connected to the internal threading (1255) of the lid aperture (255) and the mixing cup (200) is directly disposed on the paint sprayer (600).

2. The system of claim 1, wherein each paddle blade (310) further comprises an arm extension (360) projecting outwardly and away from the blade arm (320), wherein an arm extension posterior end (361) is fluidly connected to a blade arm distal end (322), wherein the arm extension (360) is parallel to the blade shoulder (330), wherein each arm extension distal end (362) is connected to each other, and wherein the flexible blade (350) is disposed on a blade outer edge (370).

3. The system (100) of claim 1, wherein the paddle (300) comprises two paddle blades (310) such that the paddle (300) has a shape of a horseshoe.

4. The system (100) of claim 1, wherein the paddle (300) comprises three paddle blades (310).

5. The system (100) of claim 1, wherein the paddle (300) comprises four paddle blades (310).

6. The system (100) of claim 1, wherein the flexible blade (350) is disposed on a blade outer edge (370).

7. The system (100) of claim 1, wherein the rotating means (500) is a motor drive (510) or a crank that attachably connects to the shaft (400) for rotation.

8. The system (100) of claim 1, wherein a cup liner (270) is slidably disposed in the mixing cup (200), wherein the cup liner (270) interfacially contacts the cup interior surface (220).

9. The system (100) of claim 1, wherein the interior opening (345) has a circular shape.

10. The system (100) of claim 1, wherein the interior opening (345) has a rectangular shape.

11. The system (100) of claim 1, wherein the interior opening (345) has an irregular shape.

12. The system (100) of claim 1, wherein the interior blade area (340) comprises at least two interior openings (345), each being devoid of obstruction.

13. The system of claim 1, wherein each paddle blade (310) is at a fixed angle relative to its neighboring paddle blade (310), wherein the fixed angle ranges from between about 45° to 180°.

14. A paint agitating paddle (300) having a plurality of paddle blades (310) fixedly attached to a paddle shaft (400), wherein each paddle blade (310) comprises a blade arm (320) extending outwardly and away from a blade shoulder (330), wherein a blade arm posterior end (321) is fluidly connected to a blade shoulder distal end (332), wherein an interior blade area (340) disposed between the blade arm (320) and the blade shoulder (330) of each paddle blade (310) comprises at least one interior opening (345) being devoid of obstruction, wherein each interior blade area (340) is directly connected to each other, wherein a flexible blade (350) is disposed on each paddle blade (310), wherein a blade shoulder posterior end (331) of each blade shoulder (330) is fixedly attached to a shaft distal end (402) of the paddle shaft (400), wherein a shaft posterior end (401) projects outwardly and away from the blade shoulder (330), wherein each paddle blade (310) is at a fixed angle with respect to each other, wherein each paddle blade (310) is affixed to the paddle shaft (400) so as to prevent independent rotation of the paddle blade (310) relative to the paddle shaft (400), wherein the paddle (300) is disposed in the cup interior cavity (240), wherein the rotating means (500) is disposed on the shaft (400) and the paddle (300) is rotated via the rotating means (500) to mix paint in the cup interior cavity (240), wherein the flexible blade (350) scrapes off the paint from the cup interior surface (220) to ensure uniform mixing of the paint, wherein the cup (200) further comprises a lid (250) having a lid aperture (255) with an internal threading (1255) centrally disposed therein, wherein the lid (250) with an internal threading (1250) is secured tightly on the open cup top (210) with an external threading (1210), wherein the paddle shaft (400) is rotatably disposed through the lid aperture (255), wherein an adapter (260) is centrally and threadably disposed in the lid aperture (255), wherein the adapter (260) comprises an adapter aperture (265) centrally disposed therein, wherein the shaft (400) is rotatably disposed through the adapter aperture (265), wherein a paint sprayer (600) is threadably connected to the internal threading (1255) of the lid aperture (255) and the mixing cup (200) is directly disposed on the paint sprayer (600).

15. The paddle of claim 14, wherein each paddle blade (310) further comprises an arm extension (360) projecting outwardly and away from the blade arm (320), wherein an arm extension posterior end (361) is fluidly connected to a blade arm distal end (322), wherein the arm extension (360) is parallel to the blade shoulder (330), wherein each arm extension distal end (362) is connected to each other, and wherein the flexible blade (350) is disposed on a blade outer edge (370).

16. The paddle of claim 14, wherein each paddle blade (310) is at a fixed angle relative to its neighboring paddle blade (310), wherein the fixed angle ranges from between about 45° to 180°.

* * * * *